US006460959B1

(12) United States Patent
Momose et al.

(10) Patent No.: US 6,460,959 B1
(45) Date of Patent: Oct. 8, 2002

(54) INK JET RECORDING APPARATUS

(75) Inventors: Kaoru Momose; Satoru Hosono, both of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/494,421

(22) Filed: Jan. 31, 2000

(30) Foreign Application Priority Data

Jan. 29, 1999 (JP) ..... 11-23306

(51) Int. Cl.[7] ..... B41J 29/38
(52) U.S. Cl. ..... 347/11; 347/10
(58) Field of Search ..... 347/11, 15, 68, 347/9, 10

(56) References Cited

U.S. PATENT DOCUMENTS

| | | | | |
|---|---|---|---|---|
| 5,359,350 A | * 10/1994 | Nakano et al. | ..... | 347/10 |
| 5,980,015 A | * 11/1999 | Saruta | ..... | 347/15 |
| 6,092,886 A | * 7/2000 | Hosono | ..... | 347/10 |

FOREIGN PATENT DOCUMENTS

| | | | | |
|---|---|---|---|---|
| EP | 0827838 A | * 3/1998 | ..... | B41J/2/21 |
| EP | 0 827 838 A2 | 11/1998 | ..... | B41J/21/215 |
| EP | 0 916 505 A | * 5/1999 | ..... | B41J/2/205 |
| JP | 35917605 | * 10/1984 | ..... | B41J/3/04 |
| JP | 2-4512 | 1/1990 | ..... | B41J/2/045 |
| JP | 403216340 | * 1/1990 | ..... | B41J/2/045 |
| JP | 9-141851 | 6/1997 | ..... | B41J/2/045 |
| JP | 9-226116 A | 9/1997 | ..... | B41J/2/045 |
| JP | 10-81012 A | 3/1998 | ..... | B41J/2/045 |
| JP | 11-20165 | 1/1999 | ..... | B41J/2/045 |
| WO | WO 98/46432 | 10/1998 | ..... | B41J/2/205 |

* cited by examiner

*Primary Examiner*—John Barlow
*Assistant Examiner*—Alfred E Dudding
(74) *Attorney, Agent, or Firm*—Sughrue Mion, PLLC

(57) ABSTRACT

A drive signal generator generates a drive signal including a first waveform component for jetting an ink drop to be a micro dot and a second waveform component for jetting an ink drop to be a middle dot. A pressure generating element varies the volume of a pressure generating chamber in accordance with the drive signal to jet an ink drop from a nozzle orifice. An ink drop to be a large dot is jetted from the nozzle orifice when the first waveform component and the second waveform component are consecutively applied to the pressure generating element. A time interval T$\mu$m between an end point of the first waveform component and a start point of the second waveform component is set so as to substantially satisfy the following equation:

$$T\mu m = \frac{n}{2}Tc$$

here, Tc denotes a natural period of the pressure generating chamber.

10 Claims, 8 Drawing Sheets

FIG. 8

| Tμm (μsec) | 6.5 | 8.5 | 9.5 | 10.5 | 11.5 | 12.5 | 13.5 | 14.5 | 16.5 | 18.5 | 20.5 | 22.5 |
|---|---|---|---|---|---|---|---|---|---|---|---|---|
| ONE-LINE JETTING PATTERN | △ | ○ | ○ | ○ | ○ | ○ | ○ | ○ | ○ | ○ | | |
| THREE-LINE JETTING PATTERN | △ | △ | △ | △ | ○ | ○ | ○ | ○ | ○ | | | |
| ALTERNATE JETTING PATTERN | × | × | △ | △ | ○ | ○ | ○ | ○ | ○ | △ | | |
| ONE-LINE OMISSION PATTERN | × | △ | △ | ○ | ○ | ○ | △ | ×× | × | ○ | ○ | △ |
| MPBF | | | | | 150 | | | 10 | | | | |

8μsec

8μsec

INK JET RECORDING APPARATUS

BACKGROUND OF THE INVENTION

This invention relates to an ink jet recording apparatus comprising a recording head for jetting ink drops through nozzle orifices for recording and in particular to an ink jet recording apparatus intended for preventing a record image failure such as missing dots.

Some ink jet recording apparatuses such as ink jet printers, which will be hereinafter referred to as recording apparatuses, jet plural types of ink drops different in weight like micro dots, middle dots, and large dots through the same nozzle orifice to improve the image quality.

A recording head used with the recording apparatus comprises, for example, piezoelectric vibrator deformed by an applied waveform signal, pressure generating chambers expanded and contracted as the piezoelectric vibrator becomes deformed, and nozzle orifices communicating with the pressure generating chambers.

With such a recording apparatus, it is necessary to make a reasonable interval between waveforms. The time interval between the waveforms affects the image quality of a record image.

That is, if the time interval shifts from the optimum value, a record failure such as a heavy dot (a dot of a larger dot diameter than the original dot diameter) or a missing dot occurs.

To prevent the record failure, record patterns for causing the record failure to easily occur, for example, a one-line jetting pattern for jetting an ink drop of a large dot every eight nozzle orifices, a three-line jetting pattern for selecting three adjacent nozzle orifices every eight nozzle orifices and jetting an ink drop of a large dot through the selected nozzle orifices, and an alternate jetting pattern for jetting an ink drop of a large dot through the odd'th and even'th nozzle orifices alternately are actually recorded and evaluated with a recording head comprising 96 nozzle orifices per row, and the time interval between the micro dot and middle dot waveforms is determined based on the evaluation result.

However, although the time interval determined by evaluation with the record patterns is adopted, a record failure occurs in some cases.

For example, when the time interval between the micro dot and middle dot waveforms is determined based on the record patterns, if a pattern where the percentage of the nozzle orifices used for recording (recording density) is high, such as a one-line omission pattern, namely, a record pattern for setting a nozzle orifice for jetting no ink drop every eight nozzle orifices and jetting an ink drop of a large dot through the nozzle orifices except the setup nozzle orifice is recorded, the above-mentioned record failure occurs in some cases.

SUMMARY OF THE INVENTION

It is therefore an object of the invention to provide an ink jet recording apparatus for making it possible to lessen record failures if a record pattern having a high recording density such as a one-line omission pattern is recorded, thereby improving recording stability.

In order to achieve the above object, there is provided an ink jet recording apparatus comprising:

- a drive signal generator for generating a drive signal including a first waveform component for jetting an ink drop to be a micro dot and a second waveform component for jetting an ink drop to be a middle dot;
- a pressure generating chamber communicated with a nozzle orifice; and

- a pressure generating element for varying the volume of the pressure generating chamber in accordance with the drive signal to jet an ink drop from the nozzle orifice.

An ink drop to be a large dot is jetted from the nozzle orifice when the first waveform component and the second waveform component are consecutively applied to the pressure generating element.

A time interval T$\mu$m between an end point of the first waveform component and a start point of the second waveform component is set so as to substantially satisfy the following equation:

$$T\mu m = \frac{n}{2}Tc$$

here, Tc denotes a natural period of the pressure generating chamber, and n is an odd number of "3" or more.

Accordingly, propagation of vibration from the adjacent pressure generation chamber or the effect in the chamber caused by crosstalk of the piezoelectric element can be suppressed.

Thus, if a record pattern having a high recording density is recorded, recording failures can be lessened, thereby-improving the recording stability.

Preferably, n is set to 3.

Accordingly, the time interval T$\mu$m becomes 1.5 times the characteristic vibration cycle of the pressure generating chamber Tc, so that the first waveform component and the second waveform component can be placed at a comparatively short time interval. Thus, to record a large dot, the remaining vibration after the first waveform component is applied can be used for jetting an ink drop of a middle dot, and the weight of the middle dot when a large dot is recorded can be made larger than the weight when the middle dot is recorded solely. Therefore, the ink drop weight range can be widened and recording can be executed in a wide dot diameter.

In order to attain the same effect, there is also provided an ink jet recording apparatus comprising:

- a drive signal generator for generating a drive signal including a first waveform component for jetting an ink drop to be a micro dot and a second waveform component for jetting an ink drop to be a middle dot;
- a pressure generating chamber communicated with a nozzle orifice; and
- a pressure generating element for varying the volume of the pressure generating chamber in accordance with the drive signal to jet an ink drop from the nozzle orifice.

An ink drop to be a large dot is jetted from the nozzle orifice when the first waveform component and the second waveform component are consecutively applied to the pressure generating element.

When a frequency distribution of occurring a recording failure increases periodically as a function of a time interval T$\mu$m between an end point of the first waveform component and a start point of the second waveform component, an actual T$\mu$m is so as to avoid a value of which the frequency distribution increases.

In these apparatuses, the drive signal includes a third waveform component applied to the pressure generating element prior to the application of the first waveform component in order to finely vibrate a meniscus of the ink in the nozzle orifice.

Preferably, a time interval between an end point of the third waveform element and a start point of the first waveform element is set as a period in which the vibration caused by the third waveform element attenuates sufficiently.

Accordingly, jetting an ink drop by the first waveform component can be stabilized.

In these apparatuses, the pressure generating element is a piezoelectric vibrator formed into a combteeth shape in which electrodes and a piezoelectric body are laminated in a direction orthogonal to a deforming direction thereof.

Here, the time interval between the end point of the first waveform component and the start point of the second waveform component is not less than 3 Tc.

Accordingly, recording failures can be prevented more effectively.

In order to attain the same effect, there is also provided an ink jet recording apparatus comprising:

a drive signal generator for generating a drive signal including a first waveform component for jetting an ink drop to be a micro dot and a second waveform component for jetting an ink drop to be a middle dot;

a pressure generating chamber communicated with a nozzle orifice; and a pressure generating element for varying the volume of the pressure generating chamber in accordance with the drive signal to jet an ink drop from the nozzle orifice, wherein an ink drop to be a large dot is jetted from the nozzle orifice when the first waveform component and the second waveform component are consecutively applied to the pressure generating element, and wherein a time interval between an end point of the first waveform component and a start point of the second waveform component is set so as to avoid ink ejection error.

Here, the time interval is represented as a function of a natural period of the pressure generating chamber.

BRIEF DESCRIPTION OF THE DRAWINGS

In the accompanying drawings:

FIG. 8 is a table showing evaluation of the record results when patterns are recorded while the time interval between the micro dot waveform and the middle dot waveform, T$\mu$m, is changed.

DETAILED DESCRIPTION OF THE PREFERRED EMBODIMENTS

Figure 1:
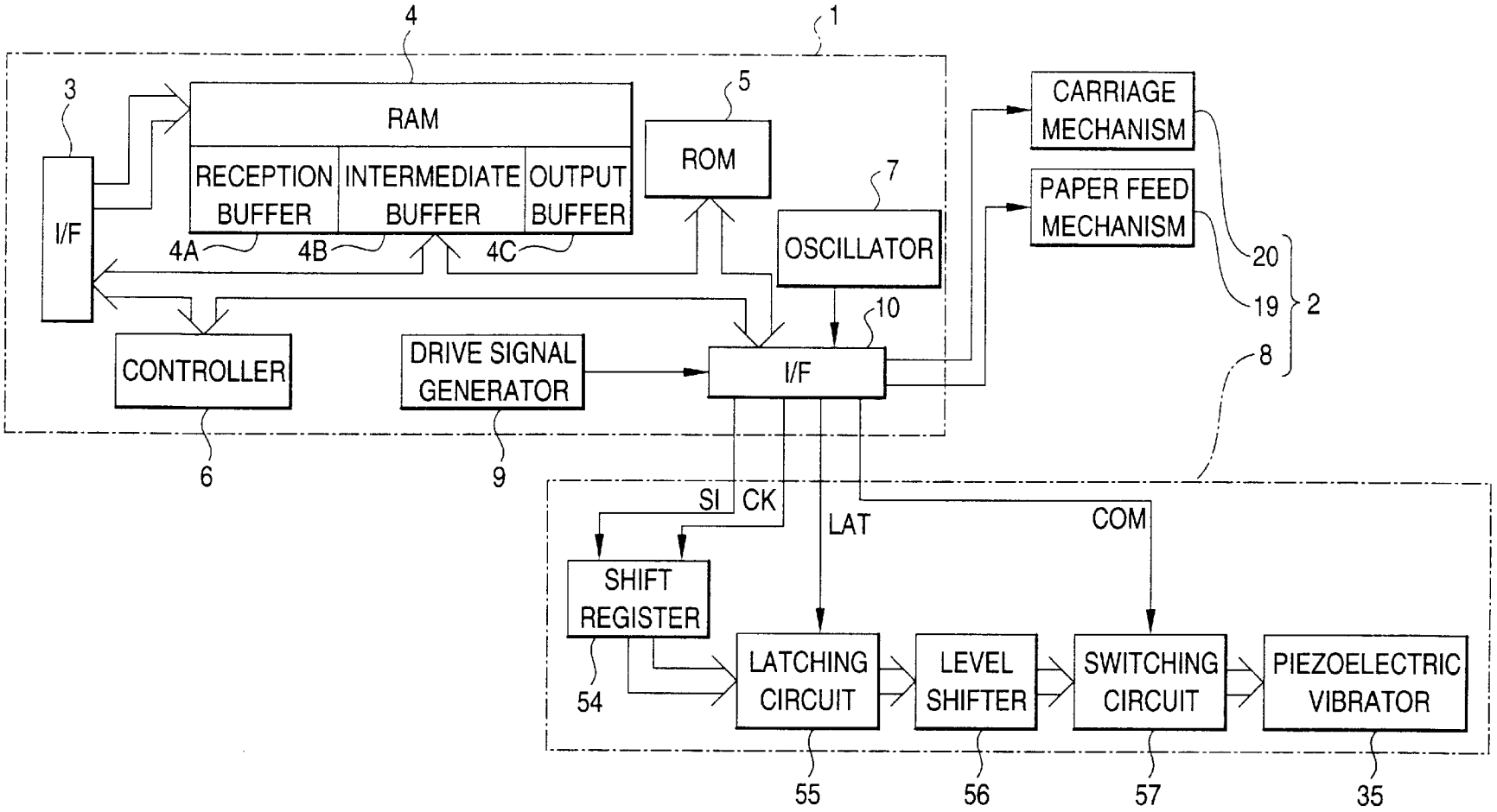
FIG. 1 is a block diagram showing the configuration of an ink jet printer.

Referring now to the accompanying drawings, there is shown an embodiment of the invention by taking an ink jet printer (simply, printer) of a representative ink jet recording apparatus as an example. As shown in FIG. 1, the printer is roughly made up of a printer controller 1 and a print engine 2.

The micro dot, middle dot, and large dot throughout the specification represent dots having ink weight increased for forming the dots in the order of the micro dot, middle dot, and large dot.

The printer controller 1 comprises an external interface 3 (external I/F 3), RAM (random access memory) 4 for temporarily storing various pieces of data, ROM (read-only memory) 5 for storing a control program, etc., a controller 6 containing a CPU (central processing unit), etc., an oscillator 7 for generating a clock signal, a drive signal generator 9 for generating a drive signal (COM) supplied to a recording head 8, and an internal interface 10 (internal I/F 10) for transmitting the drive signal and dot pattern data (bit map data) expanded based on print data and the like to the print engine 2.

The external I/F 3 receives print data made up of character code, a graphic function, image data, etc., for example, from a host computer (not shown), etc. A busy signal (BUSY) and an acknowledge signal (ACK) are output through the external I/F 3 to the host computer, etc.

The RAM 4 functions as a reception buffer 4A, an intermediate buffer 4B, an output buffer 4C, and work memory (not shown). The reception buffer 4A temporarily stores the print data received through the external I/F 3, the intermediate buffer 4B stores intermediate code data provided by the controller 6, and the output buffer 4C stores dot pattern data. The dot pattern data is print data provided by decoding (translating) gradation data.

The ROM 5 stores font data, graphic functions, etc., in addition to the control program (control routine) for performing various types of data processing.

The controller 6 performs various types of control. In addition, it reads the print data in the reception buffer 4A and stores the intermediate code data provided by converting the print data in the intermediate buffer 4B. Also, the controller 6 analyzes the intermediate code data read from the intermediate buffer 4B, references the font data, graphic function, etc., stored in the ROM 5, and expands the intermediate code data into dot pattern data. After performing necessary decoration processing, the controller 6 stores the dot pattern data in the output buffer 4C.

If one line of the dot pattern data that can be recorded by one main scanning of the recording head 8 is provided, it is output from the output buffer 4C through the internal I/F 10 to the recording head 8 in sequence. When one line of the dot pattern data is output from the output buffer, the already expanded intermediate code data is erased from the intermediate buffer and the next intermediate code data is expanded.

Figure 6:
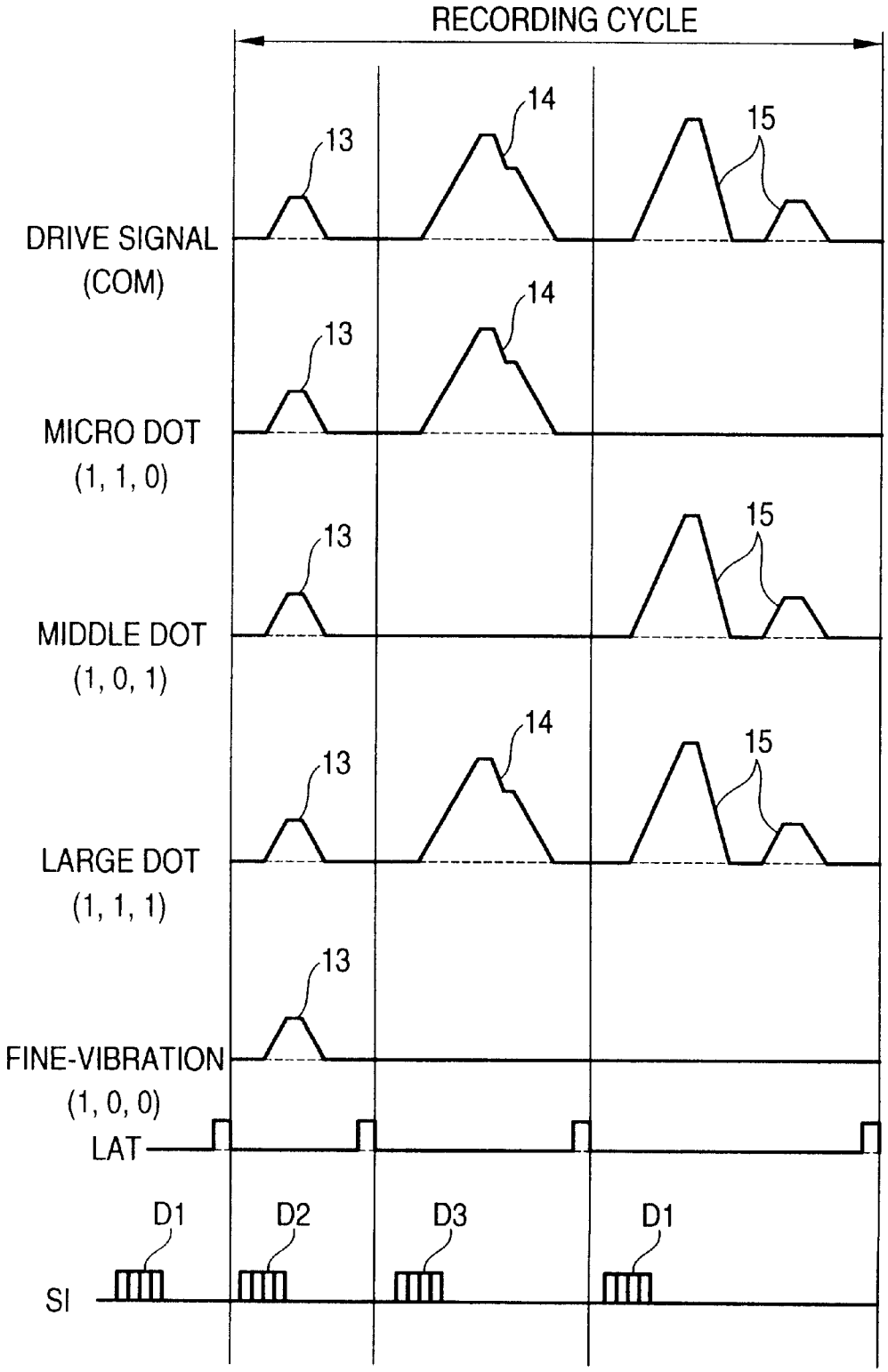
FIG. 6 is a diagram showing the relationship between drive signals and recording dots.

The drive signal generator 9 generates a drive signal as mentioned above. In the embodiment, as shown in FIG. 6, the drive signal generator 9 generates a signal sequence containing a fine-vibration waveform 13, a micro dot waveform 14, and a middle dot waveform 15 with the micro dot waveform 14 followed by the middle dot waveform 15 and preceded by the fine-vibration waveform 13 as the drive signal.

The fine-vibration waveform 13 is a waveform for agitating ink in a nozzle orifice 16 (see FIG. 3), the micro dot waveform 14 is a waveform for jetting an ink drop of a micro dot (for example, an ink drop of about 3.3 ng) through the nozzle orifice 16, and the middle dot waveform 15 is a waveform for jetting an ink drop of a middle dot (for example, an ink drop of about 10 ng) through the nozzle orifice 16.

In the embodiment, as described later, the micro dot waveform 14 and the middle dot waveform 15 are applied to the recording head 8 (namely, a piezoelectric vibrator 35 described later) consecutively, whereby the weight of the ink drop jetted according to the middle dot waveform 15 is made larger than the weight of the ink drop jetted if the middle dot waveform 15 is applied solely, thereby jetting an ink drop of a large dot (ink drop of about 20 ng in total of ink drops of micro dot and middle dot).

The drive signal will be discussed later in detail.

The print engine 2 comprises a paper feed mechanism 19, a carriage mechanism 20, and the above-mentioned recording head 8.

Figure 2:
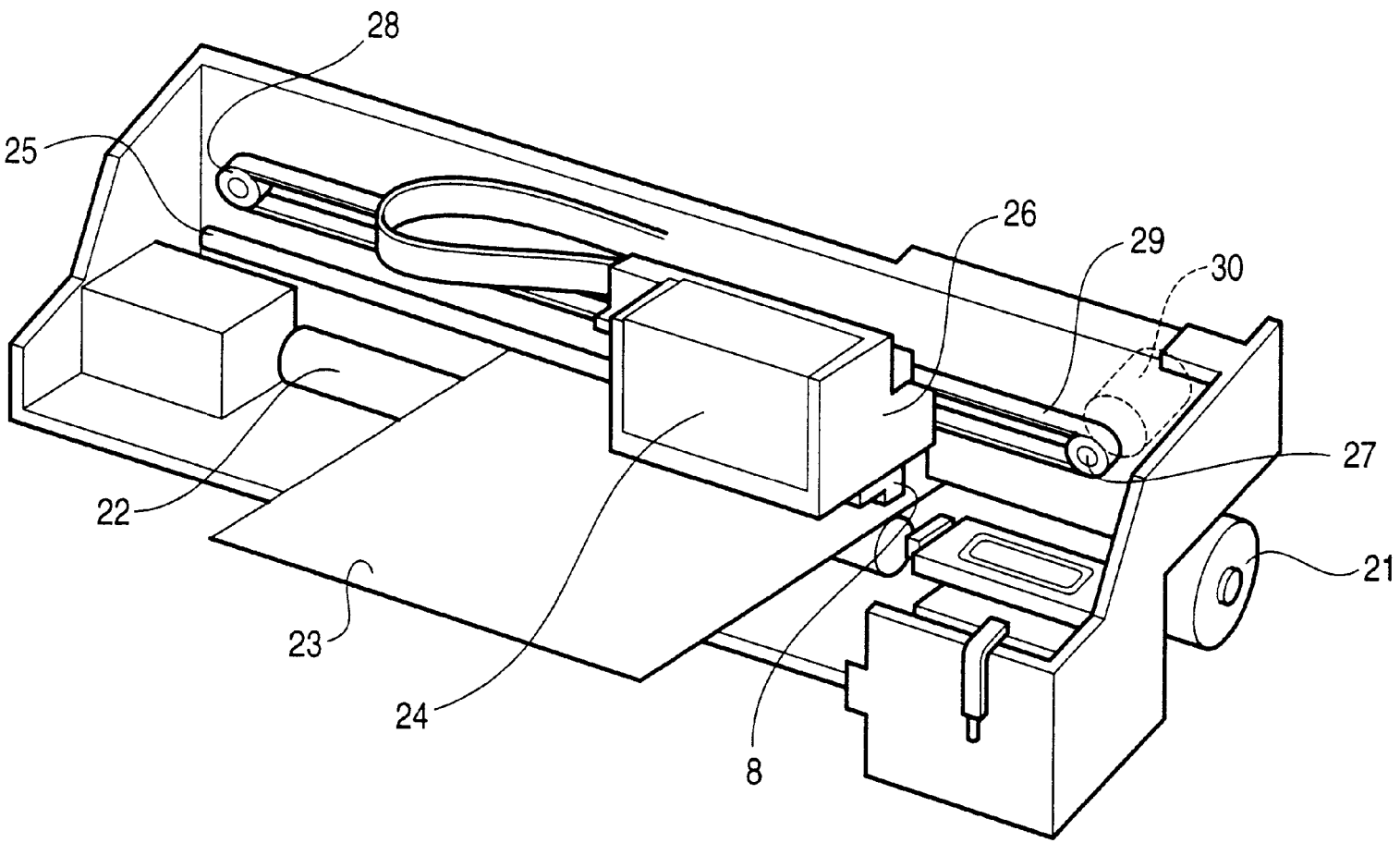
FIG. 2 is a perspective view showing the internal mechanism of the ink jet printer.

As shown in FIG. 2, the paper feed mechanism 19 is made up of a paper feed motor 21, a paper feed roller 22, etc., and feeds recording paper (a kind of print recording medium) 23 in sequence in association with the record operation of the recording head 8. That is, the paper feed mechanism 19 moves the recording paper 23 in the recording paper feed direction, which is a subscanning direction.

The carriage mechanism 20 comprises a carriage 26 on which the recording head 8 and an ink cartridge 24 can be mounted, the carriage 26 being attached to a guide member 25 movably, a timing belt 29 placed on a drive pulley 27 and a driven pulley 28 and connected to the carriage 26, and a pulse motor 30 for rotating the drive pulley 27.

In the carriage mechanism 20, the carriage 26 is reciprocated along the width direction of the recording paper 23 by the operation of the pulse motor 30. That is, the recording head 8 mounted on the carriage 26 is moved along the main scanning direction.

Figure 3:
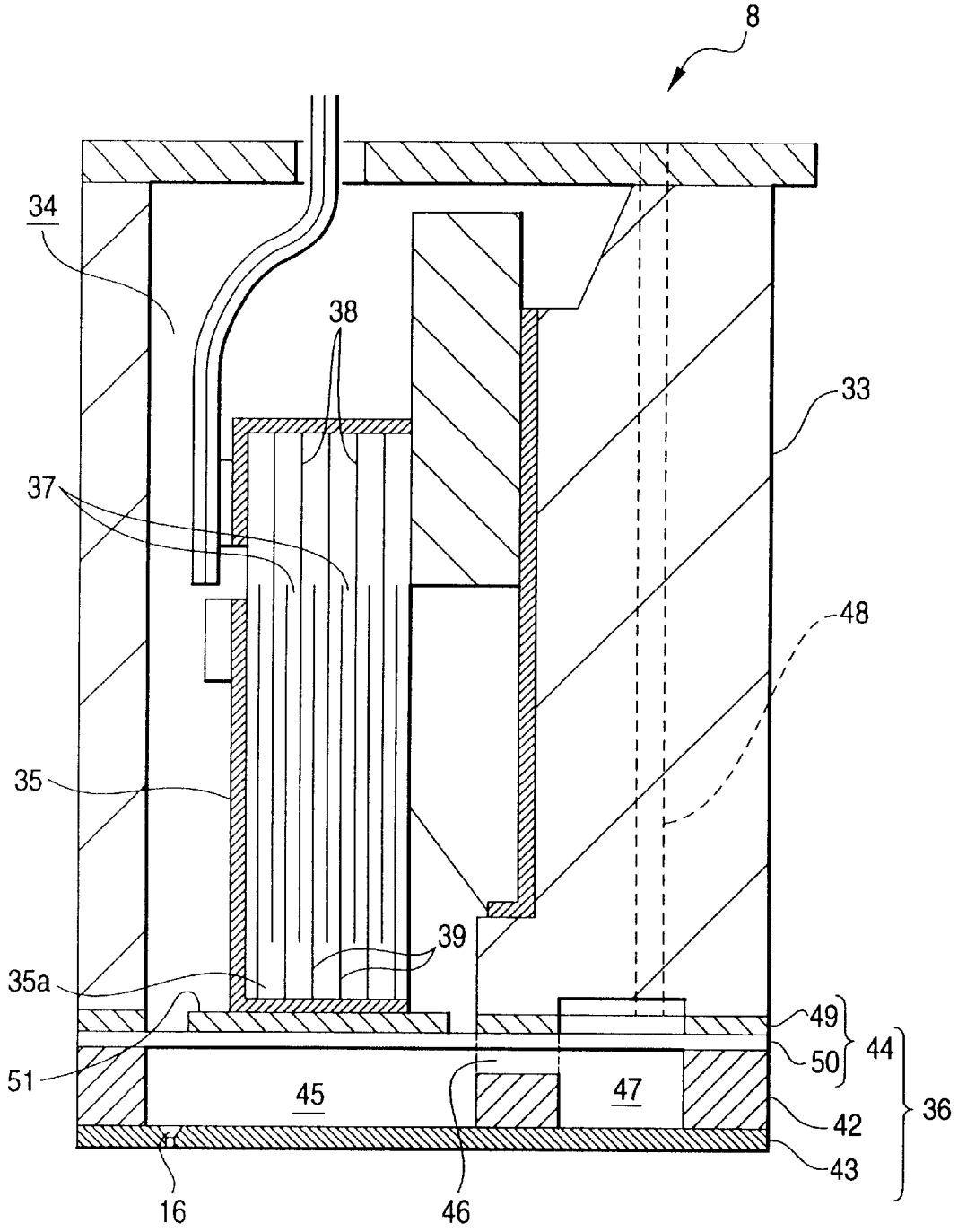
FIG. 3 is a sectional view showing the structure of a recording head.

Next, the recording head 8 will be discussed. As shown in FIG. 3, to form the recording head 8, the piezoelectric vibrator 35 shaped like comb teeth is inserted into a chamber 34 of a case 33 shaped like a plastic box, for example, through one opening, a tip 35*a* shaped like comb teeth is made to face an opposite opening, a channel unit 36 is joined to the surface (bottom face) of the case 33 on the opening side, and the tip 35*a* is abutted against and fixed to a predetermined part of the channel unit 36.

The piezoelectric vibrator 35 comprises a plate-like vibration plate comprising an alternating pattern of common internal electrodes 38 and discrete internal electrodes 39 deposited on each other with a piezoelectric body 37 in between, the vibration plate being cut like comb teeth corresponding to the dot formation density. A potential difference is given between the common internal electrode 38 and the discrete internal electrode 39, whereby each piezoelectric vibrator 35 is expanded or contracted in the longitudinal direction of the vibrator orthogonal to the deposition direction.

The channel formation plate 42 is a plate member formed with a plurality of cavities (pressure generating chambers) 45 communicating with a plurality of the nozzle orifices 16 formed in the nozzle plate 43 and partitioned by a pressure generating chamber diaphragm and an elongated common ink reservoir 47 with which a plurality of ink supply ports 46 each communicating with at least one end of each cavity 45 communicate. In the embodiment, the common ink reservoir 47 is formed by etching a silicon wafer, the cavities 45 are formed matching the pitches of the nozzle orifices 16 along the longitudinal direction of the common ink reservoir 47, and the groove-like ink supply ports 46 are formed between the cavities 45 and the common ink reservoir 47. The ink supply port 46 is connected to one end of the cavity 45 and the nozzle orifice 16 is positioned in the proximity of the end part on the opposite side to the ink supply port 46. The common ink reservoir 47 is a chamber for supplying ink stored in the ink cartridge 24 to the cavities 45, and an ink supply tube 48 communicates almost at the center in the longitudinal direction.

The elastic plate 44 is deposited on an opposite face of the channel formation plate 44 positioned on the opposite side to the nozzle plate 43 and is of a double structure comprising a polymer film of PPS, etc., laminated as an elastic film 50 on a stainless plate 49. The stainless plate 49 of the portion corresponding to the cavity 45 is etched to form an island portion 51 for abutting and fixing the piezoelectric vibrator 35.

In the described recording head 8, the piezoelectric vibrator 35 is expanded in the longitudinal direction of the vibrator, whereby the island portion 51 is pressed against the nozzle plate 43, the elastic film 50 surrounding the island portion 51 becomes deformed, and the cavity 45 is contracted. If the piezoelectric vibrator 35 is contracted in the longitudinal direction of the vibrator, the volume of the cavity 45 is expanded due to elasticity of the elastic film 50. Expansion and contraction of the volume of the cavity 45 are controlled, whereby an ink drop is jetted through the nozzle orifice 16.

Figure 4:
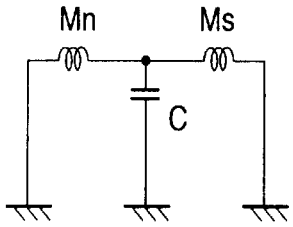
FIG. 4 is a diagram showing an equivalent circuit for explaining characteristic vibration of ink in a cavity.

The characteristic vibration of ink in the cavity 45 in the described recording head 8 can be represented by an equivalent circuit shown in FIG. 4. It is known that characteristic vibration cycle Tc of ink in the cavity 45 can be calculated according to the following expression:

$$Tc = 2\pi\sqrt{\frac{Mn \cdot Ms}{Mn + Ms}C}$$

where symbol M denotes inertance of the mass of a medium per unit length [Kg/m$^4$], symbol Mn denotes inertance in the nozzle orifice 16, symbol Ms denotes inertance in the ink supply port 46, and symbol C denotes compliance of the cavity 45 (pressure generating chamber) [m$^5$/N].

The characteristic vibration cycle Tc of ink in the cavity 45 calculated based on the expression is about 8 $\mu$sec in the embodiment.

Next, the electric configuration of the recording head 8 and control for jetting ink drops will be discussed.

Figure 5:
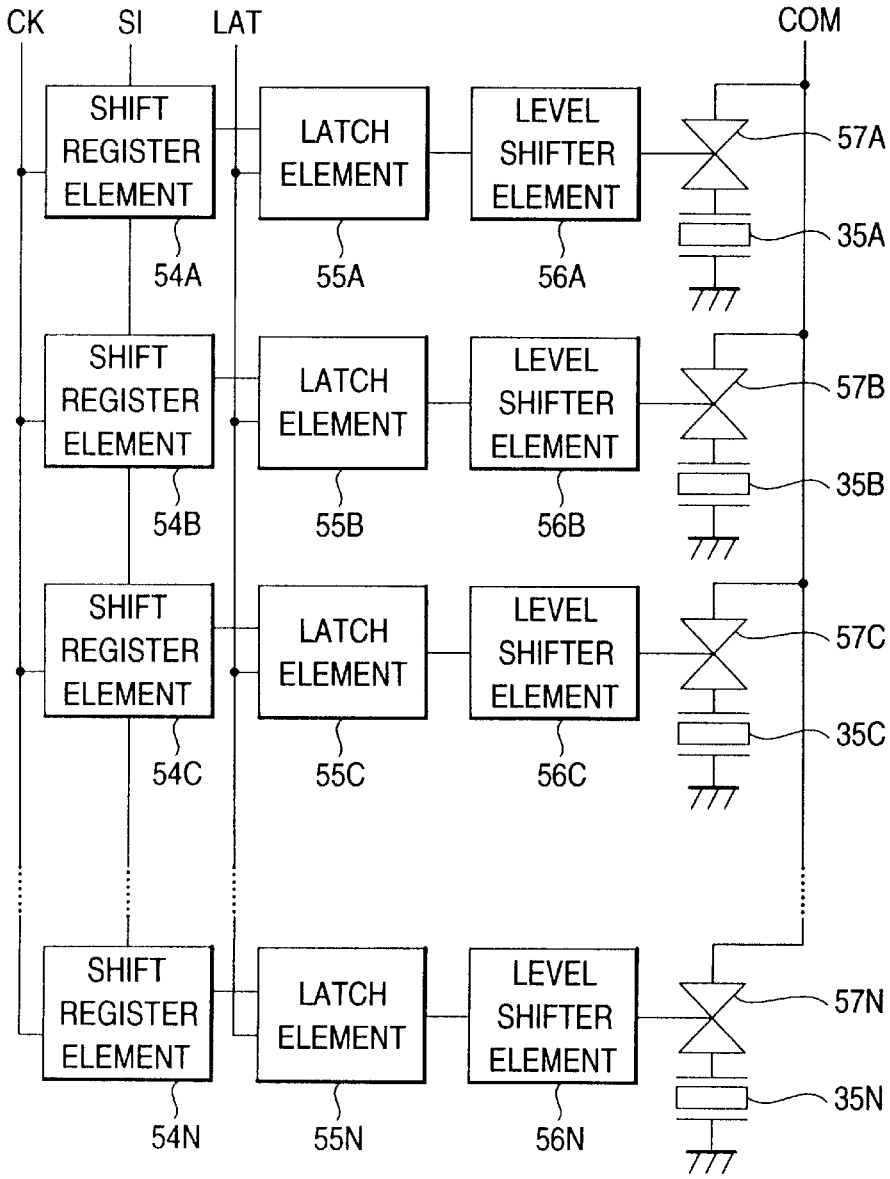
FIG. 5 is a block diagram showing the electric configuration in the recording head.

As shown in FIG. 1, the recording head 8 comprises a shift register 54, a latching circuit 55, a level shifter 56, a switching circuit 57, the above-described piezoelectric vibrator 35, etc. Further, as shown in FIG. 5, the shift register 54, the latching circuit 55, the level shifter 56, the switching circuit 57, and the above-described piezoelectric vibrator 35 consist of shift register elements 54A to 54N, latch elements 55A to 55N, level shifter elements 56A to 56N, switch elements 57A to 57N, and piezoelectric vibrators 35A to 35N, respectively, provided in a one-to-one correspondence with the nozzle orifices 16 of the recording head 8.

To jet ink drops through the recording head 8, first the controller 6 transmits print data (SI) in series starting at the most significant bit from the output buffer 4C and sets the data in the shift register elements 54A to 54N in sequence in synchronization with a clock signal (CK) from the oscillator 7. If the print data as much as all nozzle orifices 16 is set in the shift register elements 54A to 54N, the controller 6 outputs a latch signal (LAT) to the latching circuit 55, namely, the latch elements 55A to 55N at a predetermined timing. According to the latch signal, the latch elements 55A to 55N latch the print data set in the shift register elements 54A to 54N. The latched print data is supplied to the level shifter 56, a voltage amplifier, namely, the level shifter elements 56A to 56N.

For example, if the print data is "1," each level shifter element 56A–56N boosts the print data to a voltage value at which the switching circuit 57 can be driven, for example, several ten volts. The boosted print data is applied to the switching circuit 57, namely, the switch element 57A–57N, which then enters a connection state as the print data is applied. For example, the print data is "0," the corresponding level shifter element 56A–56N does not boost the print data. A drive signal (COM) from the drive signal generator 9 is applied to each switch element 57A–57N and when the switch element 57A–57N enters a connection state, the drive signal is supplied to the piezoelectric vibrator 35A–35N connected to the switch element 57A–57N.

If the drive signal is applied based on the most significant bit data, subsequently the controller 6 transmits the second most significant bit data in series and sets the data in the shift register element 54A–54N. If the data is set in the shift register element 54A–54N, the controller 6 applies a latch signal, thereby latching the set data, and supplies a drive signal to the piezoelectric vibrator 35A–35N. After this, the same operation is repeated to the least significant bit while the print data is shifted to the low-order bit one bit at a time.

Thus, in the described printer, whether or not the drive signal is to be applied to the piezoelectric vibrator 35 can be controlled based on the print data. That is, the print data is set to "1," whereby the drive signal can be applied to the piezoelectric vibrator 35; the print data is set to "0," whereby applying the drive signal to the piezoelectric vibrator 35 can be stopped.

Therefore, the drive signal is divided in a time axis direction corresponding to an fine-vibration waveform 13, a micro dot waveform 14, and a middle dot waveform 15 and the bits of the print data are set corresponding to the waveform signals 13, 14, and 15, whereby the waveform signals 13, 14, and 15 can be selectively applied to the piezoelectric vibrator 35.

In the example shown in FIG. 6, the print data consists of three data bits D1, D2, and D3; the print data bit D1 is related to the fine-vibration waveform 13, the print data bit D2 is related to the micro dot waveform 14, and the print data bit D3 is related to the middle dot waveform 15. The data bits D1, D2, and D3 are changed appropriately, whereby plural types of ink drops different in weight can be jetted through the nozzle orifice 16.

For example, if the print data is set as D1=1, D2=1, D3=0, the fine-vibration waveform 13 and the micro dot waveform 14 are applied to the piezoelectric vibrator 35 and an ink drop of a micro dot is jetted through the nozzle orifice 16. If the print data is set as D1=1, D2=0, D3=1, the fine-vibration waveform 13 and the middle dot waveform 15 are applied to the piezoelectric vibrator 35 and an ink drop of a middle dot is jetted through the nozzle orifice 16. Likewise, the print data is set as D1=1, D2=1, D3=1, whereby the fine-vibration waveform 13, the micro dot waveform 14, and the middle dot waveform 15 are applied to the piezoelectric vibrator 35 and an ink drop based on the micro dot waveform 14 and an ink drop based on the middle dot waveform 15 are jetted, forming a large dot. The print data is set as D1=1, D2=0, D3=0, whereby the fine-vibration waveform 13 is applied to the piezoelectric vibrator 35 and a meniscus, namely, a free surface of ink exposed at the nozzle orifice 16 is finely vibrated at the nozzle orifice 16, whereby the ink at the nozzle orifice 16 is agitated and is prevented from increasing viscosity.

Figure 7:
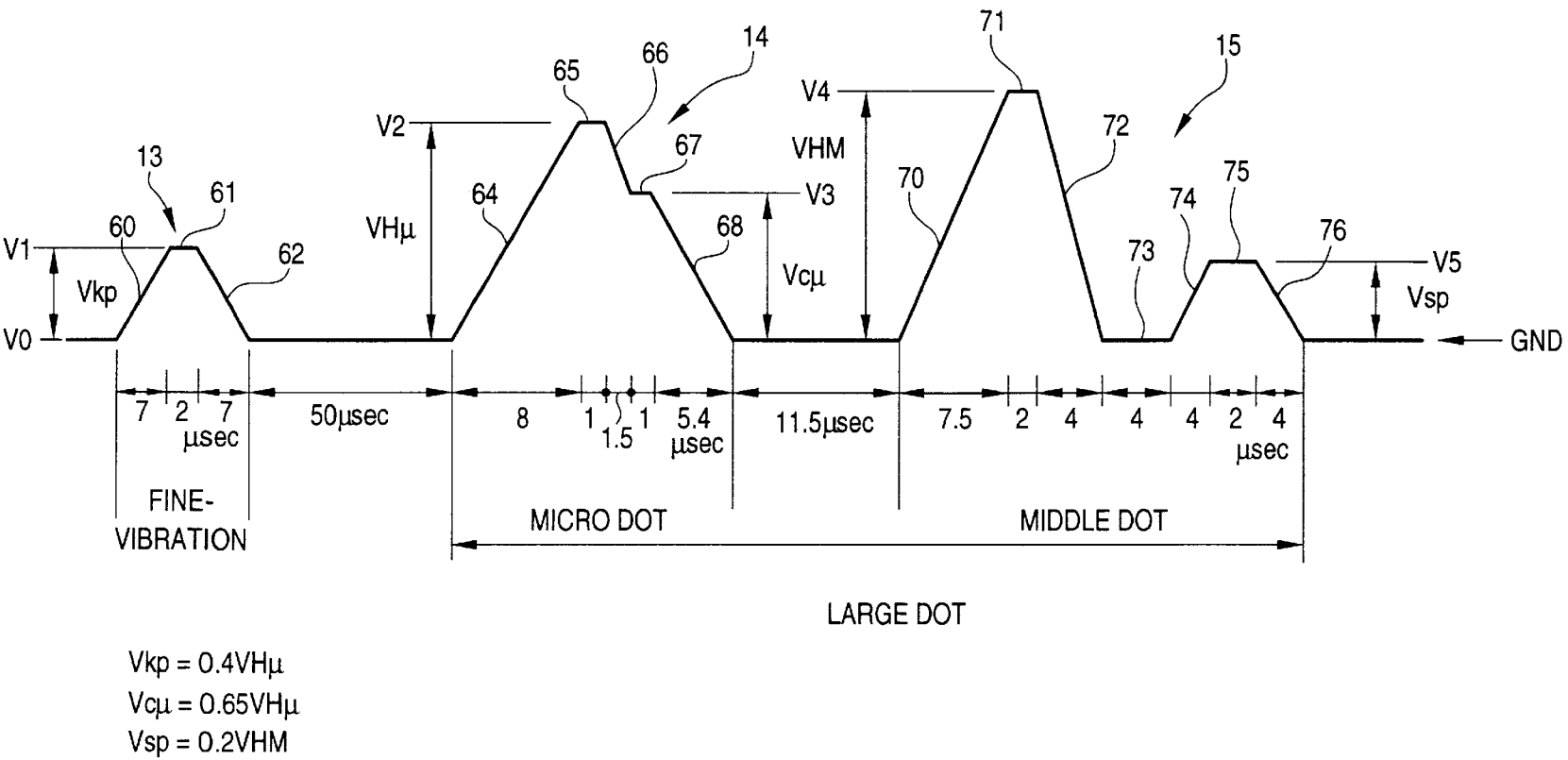
FIG. 7 is a diagram showing the drive signals.

Next, the waveforms will be discussed in detail with reference to FIG. 7. First, the fine-vibration waveform 13 will be discussed.

The fine-vibration waveform 13 is formed of a trapezoidal signal consisting of a first charge element 60 for increasing voltage at a constant gradient from GND level V0 of reference voltage to fine-vibration drive potential V1, a first hold element 61 for holding the fine-vibration drive potential V1 for a given time, and a first discharge element 62 for decreasing voltage at a constant gradient from the fine-vibration drive potential V1 to the GND level V0.

In the embodiment, potential difference Vkp between the fine-vibration drive potential V1 and the GND level V0 is set based on potential difference VH$\mu$ in the micro dot waveform 14, namely, is set to 40% of the potential difference VH$\mu$. The application time of the first charge element 60 (charging time) is set to 7 $\mu$sec, the application time of the first hold element 61 (holding time) is set to 2 $\mu$sec, and the application time of the first discharge element 62 (discharging time) is set to 7 $\mu$sec.

The fine-vibration waveform 13 is applied to the piezoelectric vibrator 35, which then is slightly contracted and expanded, and the cavity 45 is expanded and contracted only a little. The meniscus is finely vibrated with the expansion and contraction.

The micro dot waveform 14 is formed of a roughly trapezoidal signal consisting of a second charge element 64 for increasing voltage at a constant gradient from GND level V0 to micro drive potential V2, a second hold element 65 for holding the micro drive potential V2 for a given time, a second discharge element 66 for decreasing voltage at a constant gradient from the micro drive potential V2 to first intermediate potential V3, a third hold element 67 for holding the first intermediate potential V3 for a given time, and a third discharge element 68 for decreasing voltage at a constant gradient from the first intermediate potential V3 to the GND level V0.

In the embodiment, separate voltage setting is executed for each recording head so that the jetted ink weight becomes 3.3 ng with respect to potential difference VH$\mu$ between the micro drive potential V2 and the GND level V0. Potential difference Vc$\mu$ between the first intermediate potential V3 and the GND level V0 is set based on the potential difference VH$\mu$, specifically, is set to 65% of the potential difference VH$\mu$. The application time of the second charge element 64 is set to 8 $\mu$sec, the application time of the second hold element 65 is set to 1 $\mu$sec, and the application time of the second discharge element 66 is set to 1.5 $\mu$sec. The application time of the third hold element 67 is set to 1 $\mu$sec and the application time of the third discharge element 68 is set to 5.4 $\mu$sec.

When the micro dot waveform 14 is applied to the piezoelectric vibrator 35, the piezoelectric vibrator 35 is contracted by application of the second charge element 64, and the cavity 45 is expanded. The meniscus is pull into the inside of the cavity 45 with the expansion. An ink drop of an extremely minute amount (3.3 ng) is jetted by the force of the pulled-in meniscus attempting to return to the jet direction.

The middle dot waveform 15 is formed of a signal comprising an arrangement of large and small trapezoidal waveforms consisting of a third charge element 70 for increasing voltage at a constant gradient from GND level V0 to middle drive potential V4, a fourth hold element 71 for holding the middle drive potential V4 for a given time, a fourth discharge element 72 for decreasing voltage at a constant gradient from the middle drive potential V4 to the GND level V0, a fifth hold element 73 for holding the GND level V0 for a given time, a fourth charge element 74 for increasing voltage at a constant gradient from the GND level V0 to second intermediate potential V5, a sixth hold element 75 for holding the second intermediate potential V5 for a given time, and a fifth discharge element 76 for decreasing voltage at a constant gradient from the second intermediate potential VS to the GND level V0.

In the embodiment, setting is executed for each head so that the ink weight of a large dot jetted by applying the micro dot waveform 14 and the middle dot waveform 15 consecutively becomes 20 ng with respect to potential difference VHM between the middle drive potential V4 and the GND level V0. Potential difference Vsp between the second intermediate potential V5 and the GND level V0 is set based on the potential difference VHM, specifically, is set to 20% of the potential difference VHM.

The application time of the third charge element 70 is set to 7.5 $\mu$sec, the application time of the fourth hold element 71 is set to 2 $\mu$sec, and the application time of the fourth discharge element 72 is set to 4 $\mu$sec. The application time of the fifth hold element 73 is set to 4 $\mu$sec, the application time of the fourth discharge element 74 is set to 4 $\mu$sec, the application time of the sixth hold element 75 is set to 2 $\mu$sec, and the application time of the fifth discharge element 76 is set to 4 $\mu$sec When the middle dot waveform 15 is applied to the piezoelectric vibrator 35, the piezoelectric vibrator 35 is contracted by application of the third charge element 70, and the cavity 45 is expanded. The cavity 45 expanded as the piezoelectric vibrator 35 is expanded by application of the fourth discharge element 72 is contracted and an ink drop is jetted with the contraction of the cavity 45. The fourth charge element 74, the sixth hold element 75, and the fifth discharge element 76 are applied, whereby opposite-phase vibration is given to the meniscus for suppressing vibration of the meniscus.

Next, the placement intervals between the fine-vibration waveform 13 and the micro dot waveform 14 and between the micro dot waveform 14 and the middle dot waveform 15 will be discussed.

First, the time interval between the micro dot waveform 14 and the middle dot waveform 15 will be discussed. In the embodiment, the time interval between the micro dot waveform 14 and the middle dot waveform 15, namely, the time interval between the instant at which application of the third discharge element 68 ends and the instant at which application of the third charge element 70 starts is set to 11.5 μsec, about 1.5 times of the characteristic vibration cycle Tc of the cavity (in the embodiment, 8 μsec).

The reason why the interval between both the waveforms is thus determined is as follows:

FIG. 8 is a table to show evaluation of the record results when a one-line jetting pattern, a three-line jetting pattern, an alternate jetting pattern, and a one-line omission pattern are recorded with large dots while the time interval between the micro dot waveform 14 and the middle dot waveform 15, Tμm, is changed.

Figure 9A:
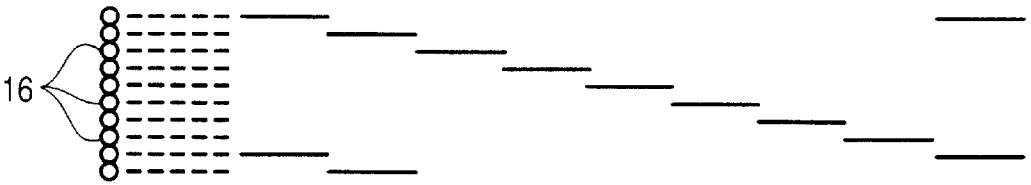
FIGS. 9A to 9D are diagrams showing record patterns for evaluation, namely, a one-line jetting pattern, a three-line jetting pattern, an alternate jetting pattern, and a one-line omission pattern, respectively.
Figure 9B:
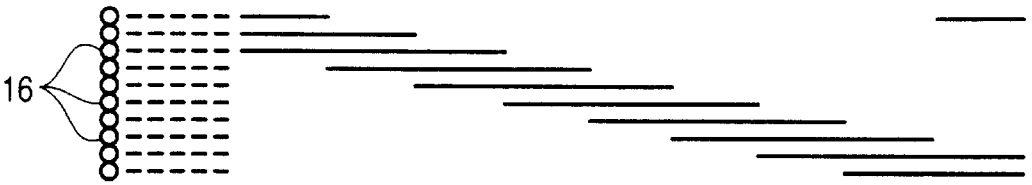
Figure 9C:
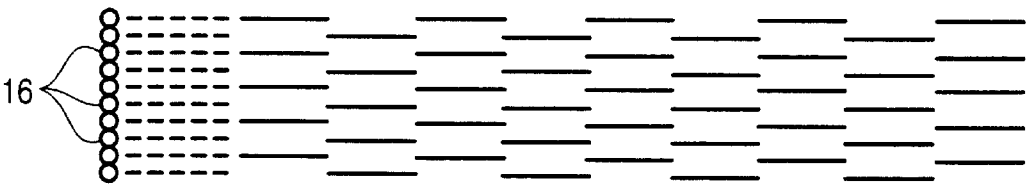
Figure 9D:
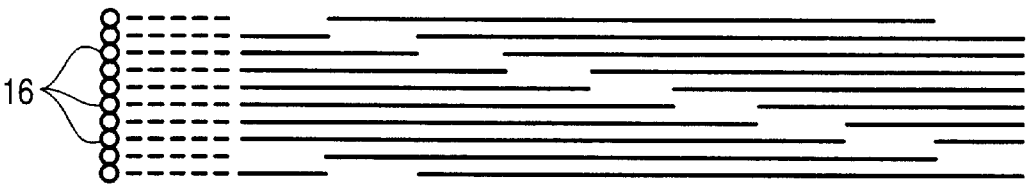

The one-line jetting pattern is a record pattern for jetting an ink drop of a large dot every eight nozzle orifices 16 as shown in FIG. 9A; the nozzle orifice 16 for jetting an ink drop is changed every given time. The three-line jetting pattern is a record pattern for selecting three adjacent nozzle orifices 16 every eight nozzle orifices and jetting an ink drop of a large dot through the selected nozzle orifices 16 as shown in FIG. 9B; the nozzle orifices 16 for jetting an ink drop are changed every given time. The alternate jetting pattern is a record pattern for jetting an ink drop of a large dot through the odd'th nozzle orifice 16 and the even'th nozzle orifice 16 alternately every given time as shown in FIG. 9C. The one-line omission pattern is a record pattern for setting a nozzle orifice 16 for jetting no ink drop every eight nozzle orifices 16 and jetting an ink drop of a large dot through the nozzle orifices 16 except the setup nozzle orifice 16 as shown in FIG. 9D. Also in the one-line omission pattern, the nozzle orifice 16 for jetting no ink drop is changed every given time.

In other words, the one-line jetting pattern is a record pattern having the lowest percentage of the nozzle orifices 16 for recording (the percentage will be hereinafter referred to as recording density) among the four patterns, and the three-line jetting pattern is a record pattern having the second lowest recording density. The alternate jetting pattern is a record pattern having the second highest recording density among the four patterns, and the one-line omission pattern is a record pattern having the highest recording density.

In FIG. 8, the evaluation results are represented by four symbols of "○,"Δ,"X," and "XX." The symbol "○" means that good recording can be performed with no failure, the symbol "Δ" means that some record failure, for example, a thick dot with wide jet pattern as compared with the normal pattern or a missing dot with jet pattern unprinted occurs, the symbol "X" means that a comparatively large number of record failures occur, and the symbol "XX" means that an extremely large number of record failures occur. Only the pattern whose evaluation result is "○" can be put to practical use.

In FIG. 8, MPBF denotes the average number of missing dot pages at the image printing time. The average number of missing dot pages means the average value from one page where a missing dot occurs to another page where another missing dot occurs when an evaluation image is recorded. For example, if the MPBF is "100," it means that a missing dot occurs about every 100 pages.

As shown in FIG. 8, in the one-line jetting pattern described above, when the time interval Tμm is 6.5 μsec, some record failure occurs, but good recording can be performed generally with no record failure.

In the three-line jetting pattern, when the time interval Tμm is in the range of 6.5 to 10.5 μsec, some record failure occurs, but when the time interval Tμm becomes 11.5 μsec or more, good recording can be performed with no record failure.

In the alternate jetting pattern, when the time interval Tμm is 6.5 μsec and 8.5 μsec, a comparatively large number of record failures occur and when the time interval Tμm is 9.5 μsec, 10.5 μsec, and 18.5 μsec, some record failure occurs. When the time interval Tμm is in the range of 11.5 to 16.5 μsec, good recording can be performed with no record failure.

In the one-line mission pattern, when the time interval Tμm is in the range of 10.5 to 12.5 μsec and 18.5 μsec and 20.5 μsec, good recording can be performed with no record failure. When the time interval Tμm is 6.5 μsec and 16.5 μsec, a comparatively large number of record failures occur and when the time interval Tμm is set to 14.5 μsec, an extremely large number of record failures occur. When the time interval Tμm is 8.5 μsec, 9.5 μsec, 13.5 μsec, and 22.5 μsec, some record failure occurs.

Thus, as the recording density becomes higher, the time intervals that can be used for good recording are limited. That is, in the one-line jetting pattern providing the lowest recording density, good recording can be performed if the time interval Tμm is 8.5 μsec or more; however, in the one-line omission pattern providing the highest recording density, good recording can be performed only in the limited ranges of the time interval Tμm from 10.5 μsec to 12.5 μsec and from 18.5 μsec to 20.5 μsec.

When the recording density becomes high, periodicity appears in the time interval Tμm where a record failure occurs. That is, in the one-line omission pattern, when the time interval Tμm is 6.5 μsec, 14.5 μsec, 16.5 μsec, 22.5 μsec, a record failure occurs; it appears every 8 μsec where the time interval Tμm where a record failure occurs is almost equal to the cavity vibration cycle Tc. When the time interval Tμm is 22.5 μsec, the evaluation is "Δ" and only some record failure occurs, but considering that the elapsed time since the micro dot waveform application time is comparatively long and that meanwhile the effect of vibration caused by the micro dot waveform is lessened, it is considered that a record failure occurs.

The record failure in the one-line omission pattern occurs when recording is executed through the nozzle orifice 16 just after the nozzle orifice 16 passes through a no-recording state. From this fact, it is considered that the record failure in the one-line omission pattern occurs receiving the effect of ink jetting through the adjacent nozzle orifices 16.

That is, vibration from the neighboring cavities propagates through the common ink reservoir 47 to the cavity (pressure generating chamber) 45 communicating with the nozzle orifice 16 not involved in recording or the piezoelectric vibrator 35 joined to the cavity 45 is vibrated because of crosstalk from the neighboring piezoelectric vibrators 35, so that needless vibration is applied.

Vibration of the meniscus slightly vibrated by the fine-vibration waveform 13 is amplified depending on the vibration application timing and resultantly the amplitude of the meniscus becomes excessively large and a bubble is taken in through the nozzle orifice 16. As the bubble is taken in, the compliance in the cavity 45 rises and first an ink drop having a large dot diameter is jetted, producing a heavy dot. As a large number of bubbles are further taken in, a missing dot occurs.

The timing at which such a record failure occurs (failure time) appears every 8 μsec almost equal to the cavity vibration cycle Tc, namely, when the time interval Tμm is 6.5 μsec, 14.5 μsec, or 22.5 μsec. Thus, a record failure can be prevented by setting the time interval Tμm to an almost intermediate point of the failure times. The possible reason why a record failure can be prevented is that if the time interval Tμm is set to an almost intermediate point of the failure times, propagation of vibration from the adjacent cavities or the effect of vibration in the cavity 45 caused by crosstalk of the piezoelectric vibrator 35 can be suppressed efficiently. Setting the time interval Tμm can also be represented as in the following expression:

$$T\mu m = \frac{n}{2}Tc$$

where Tμm [μsec] is the time interval between the micro dot waveform 14 and the middle dot waveform 15, Tc [μsec] is the characteristic vibration cycle of the cavity, and n is an odd number of "3" or more.

In the embodiment, n is set to "3" and the time interval Tμm is set to about 1.5 times the cavity vibration cycle Tc. Since the cavity vibration cycle Tc is about 8 μsec, 1.5 times the cycle becomes 12 μsec, and 11.5 μsec close to 12 μsec is set as the time interval Tμm. If the time interval Tμm is set to 11.5 μsec, MPBF (average number of missing dot pages) becomes 150 (pages); it can be confirmed that record failures can be lessened remarkably as compared with the case where the time interval Tμm is 14.5 μsec at which the MPBF value is the lowest (MPBF=10).

The reason why n is set to "3" is that the micro dot waveform 14 and the middle dot waveform 15 should be applied consecutively to the piezoelectric vibrator 35 in order to jet a large ink drop.

That is, when a large dot is jetted, the remaining vibration after the micro dot waveform 14 is applied is used, namely, the weight of an ink drop of a middle dot is made larger than the original weight 10 ng using the remaining vibration. If the time interval Tμm is too long, the effect of the remaining vibration is lessened and if the micro dot waveform 14 and the middle dot waveform 15 are applied, an ink drop of weight 13.3 ng of-the total value of the original weights results and it becomes hard to widen the weight range of an ink drop that can be jetted through the nozzle orifice 16. Since the record cycle is also prolonged, the record speed of the printer is also lowered.

Thus, if the time interval Tμm is set to about 1.5 times the cavity vibration cycle Tc, record failures can be prevented, the ink drop weight range can be widened, and the record speed of the printer can be increased.

Next, the time interval between the fine-vibration waveform 13 and the micro dot waveform 14 will be discussed. In the embodiment, the time interval between the fine-vibration waveform 13 and the micro dot waveform 14 and the middle dot waveform 15, namely, the time interval between the instant at which application of the first discharge element 62 ends and the instant at which application of the second charge element 64 starts is set to about 50 μsec.

It is considered that similar relation to that of the time interval Tμm between the micro dot waveform 14 and the middle dot waveform 15 also occurs for the time interval between the fine-vibration waveform 13 and the micro dot waveform 14. That is, it is considered that the timing at which a record failure occurs (failure time) appears every 8 μsec almost equal to the cavity vibration cycle Tc.

Then, in the embodiment, the time interval between the fine-vibration waveform 13 and the micro dot waveform 14 is set long to such an extent that the effect of vibration caused by the fine-vibration waveform 13 is not received. Specifically, the time interval is set to about 50 μsec, as shown in FIG. 7.

Concerning the time interval, as mentioned above, it is considered that the timing at which a record failure occurs appears every 8 μsec almost equal to the cavity vibration cycle Tc, specifically at the time interval 6.5 μsec, 14.5 μsec, 16.5 μsec, 22.5 μsec as in the case in FIG. 8. In the case in FIG. 8, the evaluation result at the time interval 22.5 μsec is "Δ" indicating such an extent that some record failure occurs; the possible reason is that vibration is attenuated as the time interval is prolonged.

Thus, if the time interval is set to 30.5 μsec (22.5 μsec plus characteristic vibration cycle of the cavity Tc), it is considered that the effect of vibration caused by the fine-vibration waveform 13 can be almost ignored. Therefore, it can be considered that the time interval between the fine-vibration waveform 13 and the micro dot waveform 14 at which vibration caused by the fine-vibration waveform 13 does not affect the micro dot waveform 14 (micro dot) is approximately 3 Tc or more. In other words, the time interval between the fine-vibration waveform 13 and the micro dot waveform 14 is set to approximately 3 Tc or more, whereby the effect of vibration caused by the fine-vibration waveform 13 can be eliminated and jetting an ink drop by the micro dot waveform 14 can be stabilized.

In the embodiment, the pressure generation element is formed of the comb-teeth-like vibrator 35 in so-called d31 vertical vibration mode comprising the piezoelectric body 37 and the internal electrodes 38 and 39 deposited in the direction orthogonal to the cavity pressing direction as an example; however, the invention can also be applied to a piezoelectric vibrator in so-called d33 vertical vibration mode comprising the piezoelectric body 37 and the internal electrodes 38 and 39 deposited in the cavity pressing direction and a pressure generation element using a deflection vibration mode.

The comb-teeth-like vibrator 35 in the vertical vibration mode, which is joined to the adjacent vibrator in the part on the base end side in one piece, is easily affected by crosstalk from the adjacent vibrator and a record failure easily occurs. Thus, the invention is applied to the comb-teeth-like vibrator 35 in the vertical vibration mode, whereby a record failure can be prevented more effectively.

The words "microdot", "middle dot" and "large dot" are used for describing the dot diameter in the above discussion, however, the size of ink drops ejected from the ink recording head according to the present invention is relative and thus the size of resultant ink dot is not limited to a specific size. Namely, the present invention is not limited to the three-size dot modulation, i.e., the microdot, the middle dot and the large dot, and may be applied to any ink jet recording apparatus wherein a drive signal waveform is controlled to modulate a dot size. Especially, remarkable effect can be obtained in cases where the present invention is applied to an ink jet recording apparatus wherein the dot-size modulation is realized by utilizing residual vibration of meniscus of ink in nozzle orifices.

What is claimed is:

1. An ink jet recording apparatus comprising:

a drive signal generator for generating a drive signal including a first waveform component for jetting an ink drop to be a micro dot and a second waveform component for jetting an ink drop to be a middle dot;

a pressure generating chamber communicated with a nozzle orifice; and a pressure generating element for varying the volume of the pressure generating chamber in accordance with the drive signal to jet an ink drop from the nozzle orifice, wherein an ink drop to be a large dot is jetted from the nozzle orifice when the first waveform component and the second waveform component are consecutively applied to the pressure generating element, and wherein a time interval Tμm between an end point of the first waveform component and a start point of the second waveform component is set so as to substantially satisfy the following equation:

$$T\mu m = \frac{n}{2}Tc$$

here, Tc denotes a natural period of the pressure generating chamber, and n is an odd number of "3" or more.

2. The ink jet recording apparatus as set forth in claim 1, wherein n=3.

3. The ink jet recording apparatus as set forth in claim 1, wherein the drive signal includes a third waveform component applied to the pressure generating element prior to the application of the first waveform component in order to finely vibrate a meniscus of the ink in the nozzle orifice, and wherein a time interval between an end point of the third waveform element and a start point of the first waveform element is set as a period in which the vibration caused by the third waveform element attenuates sufficiently.

4. The ink jet recording apparatus as set forth in claim 1, wherein the pressure generating element is a piezoelectric vibrator formed into a combteeth shape in which electrodes and a piezoelectric body are laminated in a direction orthogonal to a deforming direction thereof.

5. The ink jet recording apparatus as set forth in claim 4, wherein the time interval between the end point of the first waveform component and the start point of the second waveform component is not less than 3Tc.

6. An ink jet recording apparatus comprising:

a drive signal generator for generating a drive signal including a first waveform component for jetting an ink drop to be a micro dot and a second waveform component for jetting an ink drop to be a middle dot;

a pressure generating chamber communicated with a nozzle orifice; and a pressure generating element for varying the volume of the pressure generating chamber in accordance with the drive signal to jet an ink drop from the nozzle orifice, wherein an ink drop to be a large dot is jetted from the nozzle orifice when the first waveform component and the second waveform component are consecutively applied to the pressure generating element, and wherein when a frequency distribution of occurring a recording failure is represented as a function of a time interval Tμm between an end point of the first waveform component and a start point of the second waveform component, an actual Tμm is set so as to avoid a value of which the frequency distribution increases.

7. The ink jet recording apparatus as set forth in claim 6, wherein the drive signal includes a third waveform component applied to the pressure generating element prior to the application of the first waveform component in order to finely vibrate a meniscus of the ink in the nozzle orifice, and wherein a time interval between an end point of the third waveform element and a start point of the first waveform element is set as a period in which the vibration caused by the third waveform element attenuates sufficiently.

8. The ink jet recording apparatus as set forth in claim 6, wherein the pressure generating element is a piezoelectric vibrator formed into a comb-teeth shape in which electrodes and a piezoelectric body are laminated in a direction orthogonal to a deforming direction thereof.

9. The ink jet recording apparatus as set forth in claim 5, wherein the frequency distribution increases periodically.

10. An ink jet recording apparatus comprising:

a drive signal generator for generating a drive signal including a first waveform component for jetting an ink drop to be a micro dot and a second waveform component for jetting an ink drop to be a middle dot;

a pressure generating chamber communicated with a nozzle orifice; and a pressure generating element for varying the volume of the pressure generating chamber in accordance with the drive signal to jet an ink drop from the nozzle orifice, wherein:

an ink drop to be a large dot is jetted from the nozzle orifice when the first waveform component and the second waveform component are consecutively applied to the pressure generating element, a time interval between an end point of the first waveform component and a start point of the second waveform component is set so as to avoid ink ejection error, and the time interval is represented as a function of a natural period of the pressure generating chamber.

* * * * *